United States Patent [19]

Yamanaka

[11] Patent Number: 4,991,830

[45] Date of Patent: Feb. 12, 1991

[54] PAPER SUPPLY APPARATUS

[75] Inventor: Toshio Yamanaka, Hyogo, Japan

[73] Assignee: Konica Corporation, Tokyo, Japan

[21] Appl. No.: 401,787

[22] Filed: Sep. 1, 1989

[30] Foreign Application Priority Data

Sep. 7, 1988 [JP] Japan ..... 63-117815[U]

[51] Int. Cl.[5] ..... B65H 3/44

[52] U.S. Cl. ..... 271/9; 271/117; 271/127

[58] Field of Search ..... 271/9, 117, 118, 127

[56] References Cited

U.S. PATENT DOCUMENTS 4,087,178 5/1978 Pfeifer ..... 271/117 X 4,872,660 10/1989 Kameyama ..... 271/117 X 4,896,871 1/1990 Idenawa ..... 271/127 X

*Primary Examiner*—Richard A. Schacher

*Attorney, Agent, or Firm*—Finnegan, Henderson, Farabow, Garrett, and Dunner

[57] ABSTRACT

A paper supply apparatus having a main recording paper stacking table having its front end disposed below a paper pressing portion of the paper supply roller, and an auxiliary recording paper stacking table disposed above the main recording paper stacking table. The front end of the main recording paper stacking table is urged toward the paper pressing portion of the paper supply roller or away from the paper pressing portion of the paper supply roller by an oscillation device for oscillating the main recording paper stacking table. When the front end of the main recording paper stacking table is away from the paper pressing portion of the paper supply roller, an auxiliary recording paper is stacked on the auxiliary recording paper stacking table, and when the front end of the main recording paper stacking table is moved toward the paper pressing portion of the paper supply roller, the auxiliary recording paper stacked on the auxiliary recording paper stacking table is brought into contact with the paper pressing portion of the paper supply roller.

4 Claims, 6 Drawing Sheets

1
2
3
3a
3b
4
5
6
7
8
9
10
11
12
13
14
15
16
17
18
19
20
21
22
22a
22b
22c
22d
25
26
27
28
29
30
31
32
33
35
S
P1

PAPER SUPPLY APPARATUS

BACKGROUND OF THE INVENTION

1. Field of the Invention

This invention relates to a paper supply apparatus and more particularly to a paper supply apparatus used in the recording apparatuses such as printers and reproducing machines.

2. Description of the Prior Art

There have been known recording apparatuses such as printers and reproducing machines which comprise: a main paper supply system for feeding paper from a main recording paper container such as a paper cassette; and an auxiliary paper supply system for feeding paper from an auxiliary recording paper container capable of accommodating several sheets of recording paper. Such auxiliary paper supply system is generally called a multi-stack bypass.

In this kind of recording apparatuses, a paper supply mechanism such as a paper supply roller is required for each of the main and auxiliary paper supply systems. This in turn increases the size of the apparatus as well as the cost.

Another type of the recording apparatus was developed which needs only one paper supply mechanism such as the paper supply roller. In this type, the paper supply mechanism must be moved between the main paper supply system and the auxiliary paper supply system. This kind of recording apparatus, therefore, requires another mechanism for moving the paper supply mechanism, making the apparatus large in size and costly.

SUMMARY OF THE INVENTION

The object of this invention is to provide a paper supply apparatus which is capable of supplying recording paper from the auxiliary recording paper container in addition to the main recording paper container and which can be formed in simple construction with a small size and low cost.

The paper supply apparatus according to this invention comprises:

- a main recording paper stacking table having its front end disposed below a paper pressing portion of the paper supply roller, the main recording paper stacking table being oscillatably supported in such a manner that its front end can be moved toward or away from the paper pressing portion of the paper supply roller;
- an auxiliary recording paper stacking table disposed above the main recording paper stacking table, the front end of the auxiliary recording paper stacking table extending close to the paper pressing portion of the paper supply roller;
- a main recording paper stacking table urging means for urging the front end of the main recording paper stacking table toward the paper pressing portion of the paper supply means; and
- an oscillation means for oscillating the main recording paper stacking table against the force of the main recording paper stacking table urging means.

When the recording paper placed on the main recording paper stacking table is used for recording, the main recording paper stacking table urging means urges the front end of the main recording paper stacking table upwardly to press the upper surface of the front part of the uppermost paper stacked on the table against the paper pressing portion of the paper roller, feeding the paper on the table by the paper supply roller into the recording apparatus in which the paper supply apparatus is installed.

When the paper on the auxiliary recording paper stacking table is used for recording, the recording paper stacking table oscillating means causes the front end of the main recording paper stacking table to be moved away from the paper pressing portion of the paper supply roller, thus forming a gap between the upper surface of the front part of the uppermost paper stacked on the main recording paper stacking table and the paper pressing portion of the paper supply roller.

Then recording paper is placed on the auxiliary recording paper stacking table, and the front end of the recording paper is advanced between the upper surface of the front part of the uppermost paper on the main recording paper stacking table and the paper pressing portion of the paper supply roller. Then the main recording paper stacking table urging means urges the front end of the main recording paper stacking table upwardly. The paper on the upwardly urged main recording paper stacking table then presses the front end of the recording paper on the auxiliary recording paper stacking table against the pressing portion of the paper supply roller. In this way, the recording paper on the auxiliary recording paper stacking table is taken by the paper supply roller into the recording apparatus in which the paper supply apparatus is incorporated.

Other objects and features of the invention will become apparent from the following description taken in conjunction with the attached drawings.

BRIEF DESCRIPTION OF THE DRAWINGS

FIGS. 4 to 6 show recording papers being supplied from an auxiliary recording paper stacking table; in which FIG. 4 is a vertical cross section showing a main recording paper stacking table moved downwardly, FIG. 5 is a vertical cross section showing the upper front end portion of the recording paper on the auxiliary recording paper stacking table pressed against a paper supply roller; and FIG. 6 is a cross section taken along the line VI—VI of FIG. 5.

DESCRIPTION OF THE PREFERRED EMBODIMENT

Now, by referring to the accompanying drawings, one embodiment of this invention as applied to the paper supply apparatus of laser printers will be described.

Figure 1:
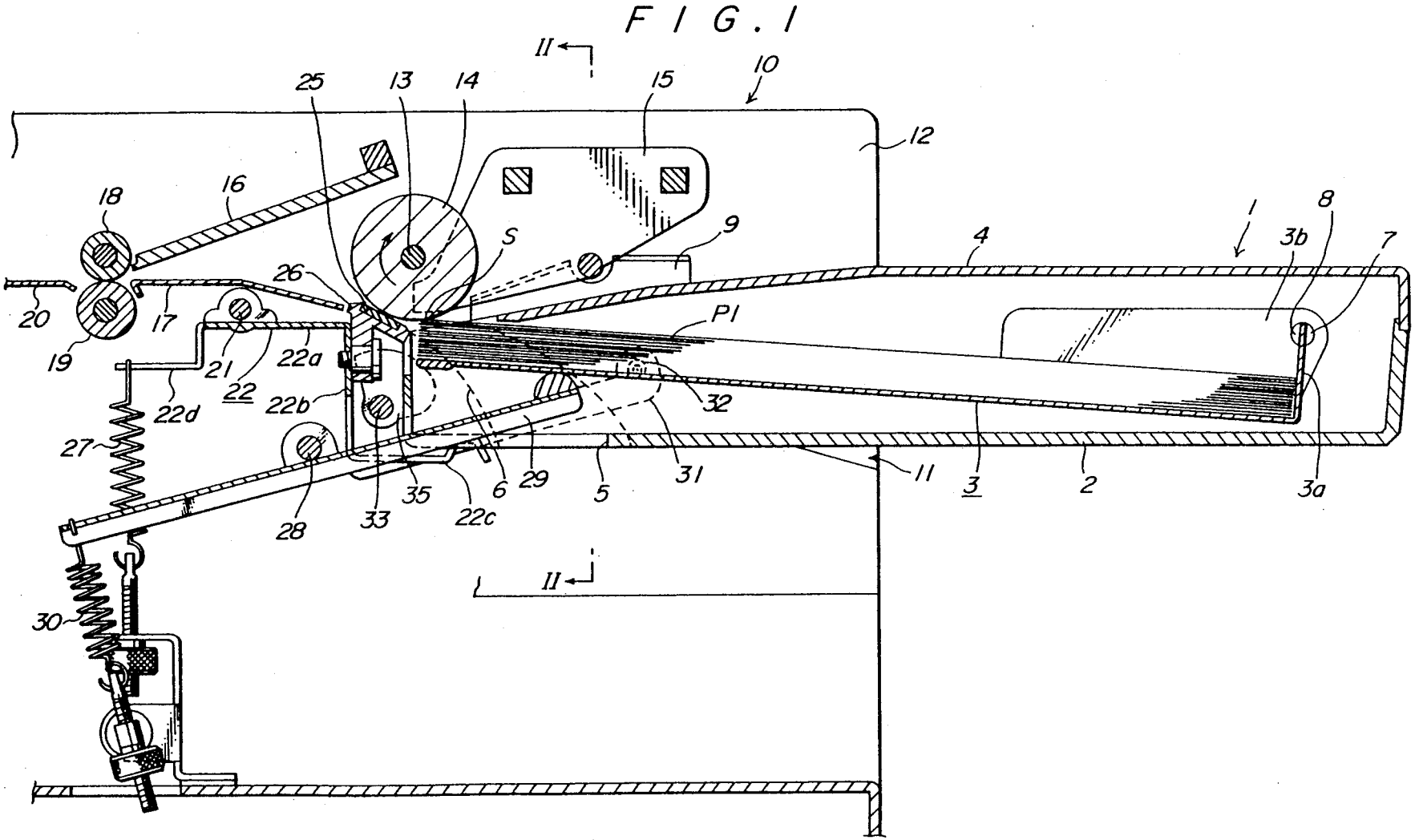
FIG. 1 is a vertical cross section of a paper feeding section of the laser printer.
Figure 2:
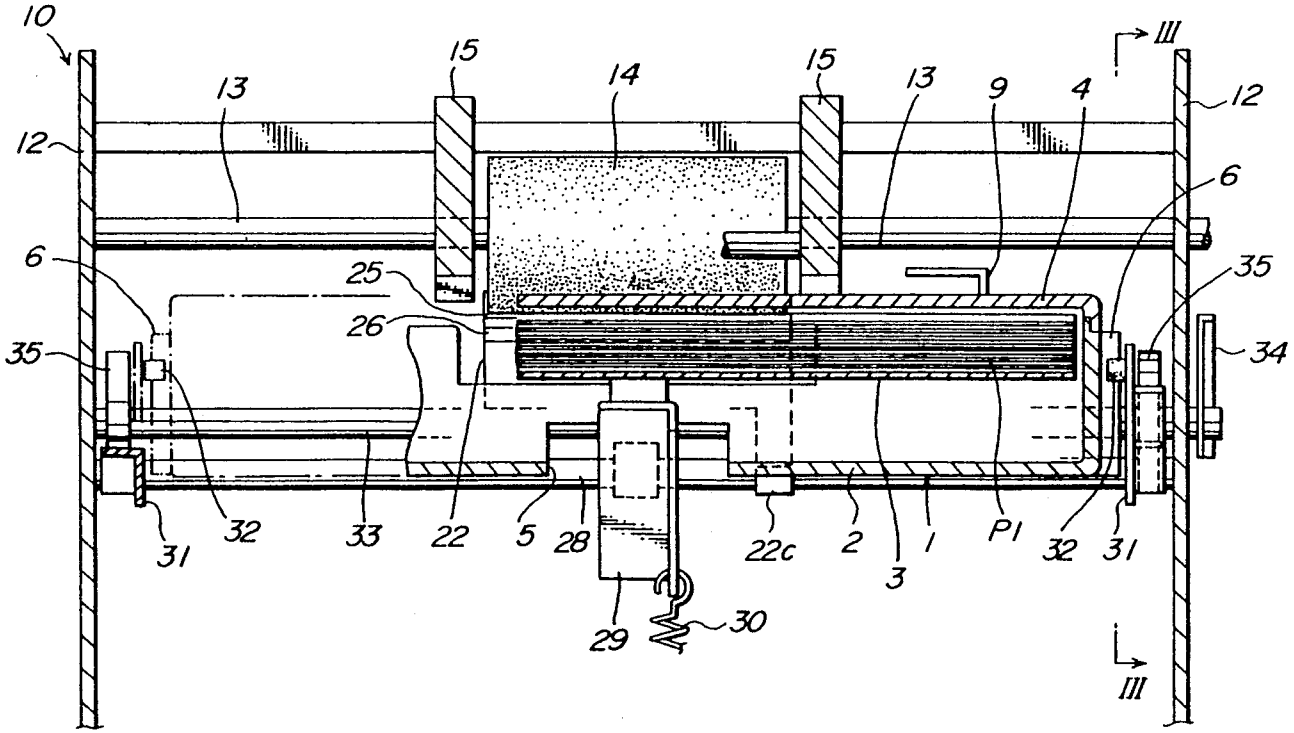
FIG. 2 is a cross section taken along the line II—II of FIG. 1.
Figure 3:
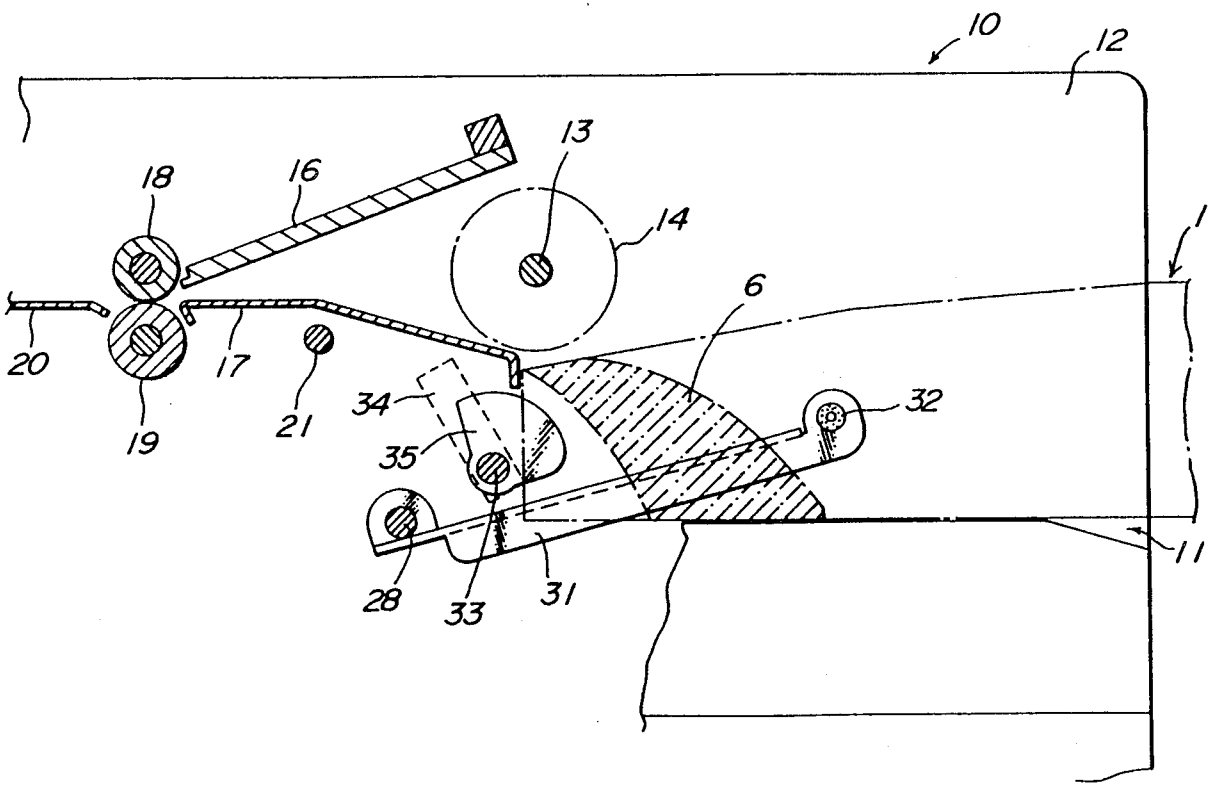
FIG. 3 is a cross section taken along the line III—III of FIG. 2.

In FIGS. 1 to 3, a case of a laser printer 10 has a cassette insertion opening 11 formed at the back, into which a front part of a paper cassette 1 is inserted to be mounted in the printer 10. Inside the printer 10 above the front end of the paper cassette 1, a horizontal rotating shaft 13 is rotatably supported at each end by side frames 12 of the printer 10. A paper supply roller 14 is rigidly mounted on the rotating shaft 13 at a lengthwise central portion thereof. The rotating shaft 13 is driven by a motor (not shown). The lower portion of the outer circumference of the paper supply roller 14 forms a paper pressing portion S.

The paper cassette 1 consists of: a case 2, U-shaped in lateral cross section; a main recording paper stacking table 3 oscillatably supported by and installed inside the case 2 in such a way that the front end of the main recording paper stacking table 3 can be moved toward and away from the paper pressing portion S of the paper supply roller 14; and an auxiliary recording paper stacking table 4 serving also as a cassette cover which is arranged above the main recording paper stacking table 3 and whose front end extends close to the paper pressing portion S of the paper supply roller 14.

The case 2 has windows 5 cut in a lower part of a front wall and also in the front end of a bottom wall at a central part, widthwise, of the case 2, these windows 5 communicating with each other. On the outer surface of each side wall of the case 2 near the front end, a plate cam 6 is mounted which is formed into a curved surface that rises toward the front in such a manner that it looks like a beak when seen from the side. The main recording paper stacking table 3 has a rear end guide 3*a* that projects upwardly at the rear end and side guides 3*b* projecting upwardly on each side at the rear end, these guides 3*a*, 3*b* being formed as one piece.

The side guides 3*b* have holes 7 at the corresponding positions, at the upper rear portion thereof. Inward projections 8 of the side walls of the case 2 are loosely fitted into these holes 7 so that the main recording paper stacking table 3 is oscillatably supported on the case 2. A number of sheets of recording paper P1 are stacked on the main recording paper stacking table 3.

The front half of the auxiliary recording paper stacking table 4 is inclined downwardly toward the paper pressing portion S of the paper supply roller 14. There is a gap between the front end of the auxiliary recording paper stacking table 4 and the front wall of the case 2. The lower portion of the paper supply roller 14 is disposed close to this gap. On the upper surface of the auxiliary recording paper stacking table 4, there are a pair of left and right paper width adjust guides 9 which can be moved closer together or away from each other.

On the rear side of and near each end of the rotating shaft 13 of the paper supply roller 14 are arranged a pair of left and right bypass guide plates 15 that guide recording papers P2 (see FIG. 5) placed on the auxiliary recording paper stacking table 4 to the paper pressing portion S of the paper supply roller 14. On the front side of the paper supply roller 14 are installed a pair of vertically arranged guide plates 16, 17 which guide the recording paper P1, P2 delivered from the paper supply roller 14 toward the front and which are so set that a vertical gap between the paired guide plates 16, 17 becomes narrower toward the front. In front of these guide plates 16, 17 a pair of vertically arranged feed rollers 18, 19 are installed which extend laterally. One of the two feed rollers 18, 19 is driven by a motor (not shown). A longitudinally extending guide plate 20 is disposed in front of the feed rollers 18, 19.

Below the pair of guide plates 16, 17 is a horizontal rotating shaft 21 that is rotatably supported at each end on the side frames of the printer 10. A pad mounting member 22 is attached to a widthwise central portion of the rotating shaft 21. The pad mounting member 22 consists of: a first horizontal plate portion 22a secured to the rotating shaft 21; a vertical plate portion 22*b* extending downwardly from the rear end of the first horizontal plate portion 22*a*; a second horizontal plate portion 22*c* extending rearwardly from the lower end of the vertical plate portion 22*b*; and an L-shaped plate portion 22*d* extending downwardly from the front end of the first horizontal plate portion 22*a* and then extending forwardly. The lower half of the vertical plate portion 22*b* and one side of the second horizontal plate portion 22*c* are cut off to prevent interference with an oscillating plate 29 described later. A pad retainer 26 having a friction pad 25 on its upper surface is mounted by screw to an upper central part of the vertical plate portion 22*b* of the pad mounting member 22. The front end of the pad mounting member 22 is urged downwardly by a coil spring 27 so that the friction pad 25 is pressed against a circumferential surface of the paper supply roller 14 at a point slightly in front, clockwise, of the paper pressing portion S.

In front of the lower part of the vertical plate portion 22*b* of the pad mounting member 22 is arranged a horizontal rotating shaft 28 which is rotatably supported at each end on the side frames 12 of the printer 10. The rotating shaft 28 has the oscillating plate 29 mounted at a lengthwise central portion thereof for pushing the front part of the main recording paper stacking table 3 upwardly. The front end of the oscillating plate 29 is urged downwardly by a coil spring 30 so that the oscillating plate 29 is urged to rotate counterclockwise about the rotating shaft 28. The rear end of the oscillating plate 29 is inserted into the case 2 passing through the window 5 of the case 2 of the paper cassette 1 and pushes a front part of the main recording paper stacking table 3 upwardly. This causes the upper front end of the uppermost paper P1 stacked on the table 3 to be pressed against the paper pressing portion S of the paper supply roller 14.

A lever 31 extending rearwardly parallel to the oscillating plate 29 is secured to each end of the rotating shaft 28 to which the oscillating plate 29 is fixed.

Rotatably mounted to the rear end of each lever 31 is a roll 32 that acts upon the beak-shaped plate cam 6 of the cassette case 2.

Between the front end of the paper cassette 1 and the vertical plate portion 22*b* of the pad mounting member 22 a horizontal rotating shaft 33 is rotatably supported at each end by the side frames 12 of the printer 10. One end of the rotating shaft 33 projects outwardly from the frame 12 and the projected end is attached with an operation lever 34. The rotating shaft 33 is securely fitted near its ends with sector plate cams 35 that act on the corresponding roll-attached levers 31.

The sector plate cams 35 are normally positioned as shown in FIG. 1. When the paper cassette 1 is not loaded in the printer 10, the upper surfaces of the front ends of the levers 31 are engaged with the sector plate cams 35 so that the levers 31 and the oscillating plate 29 are kept in an inclined state, at a position further rotated counterclockwise through a predetermined angle from the state shown in FIG. 1. In this state, when the paper cassette 1 is inserted into the cassette insertion opening 11, the rolls 32 of the levers 31 come into contact with the front surface of the beak-like plate cams 6 of the cassette case 2. As the paper cassette 1 moves forwardly, the rolls 32 move downwardly along the front surface of the plate cams 6. The oscillating plate 29 and the levers 31 then rotate clockwise against the force of the spring 30, the rear end of the oscillating plate 29 moves downwardly from the upper edge of the window 5 of the cassette case 2, and the oscillating plate 29 comes to a position where it will not interfere with the front end wall of the case 2.

As the paper cassette 1 is further moved forwardly, the rolls 32 of the levers 31 disengage from the lower end of the front surface of the beak-like plate cams 6 of the cassette case 2 and roll along the underside of the plate cams 6. When the paper cassette 1 is inserted to the specified position, the rolls 32 disengage from the rear end of the underside of the plate cams 6, allowing the oscillating plate 29 and the levers 31 to be rotated counterclockwise by the spring 30, with the result that the oscillating plate 29 pushes the front part of the main recording paper stacking table 3 upwardly. This causes the upper surface of the front end portion of the uppermost recording paper P1 stacked on the table 3 to be pressed against the paper pressing portion S of the paper supply roller 14, as shown in FIG. 1. In this state, the paper supply roller 14 and the feed rollers 18, 19 are rotated, feeding the recording paper P1 stacked on the main recording paper stacking table 3 into the printer 10, one sheet at a time from the top of the stacked papers.

Figure 4:
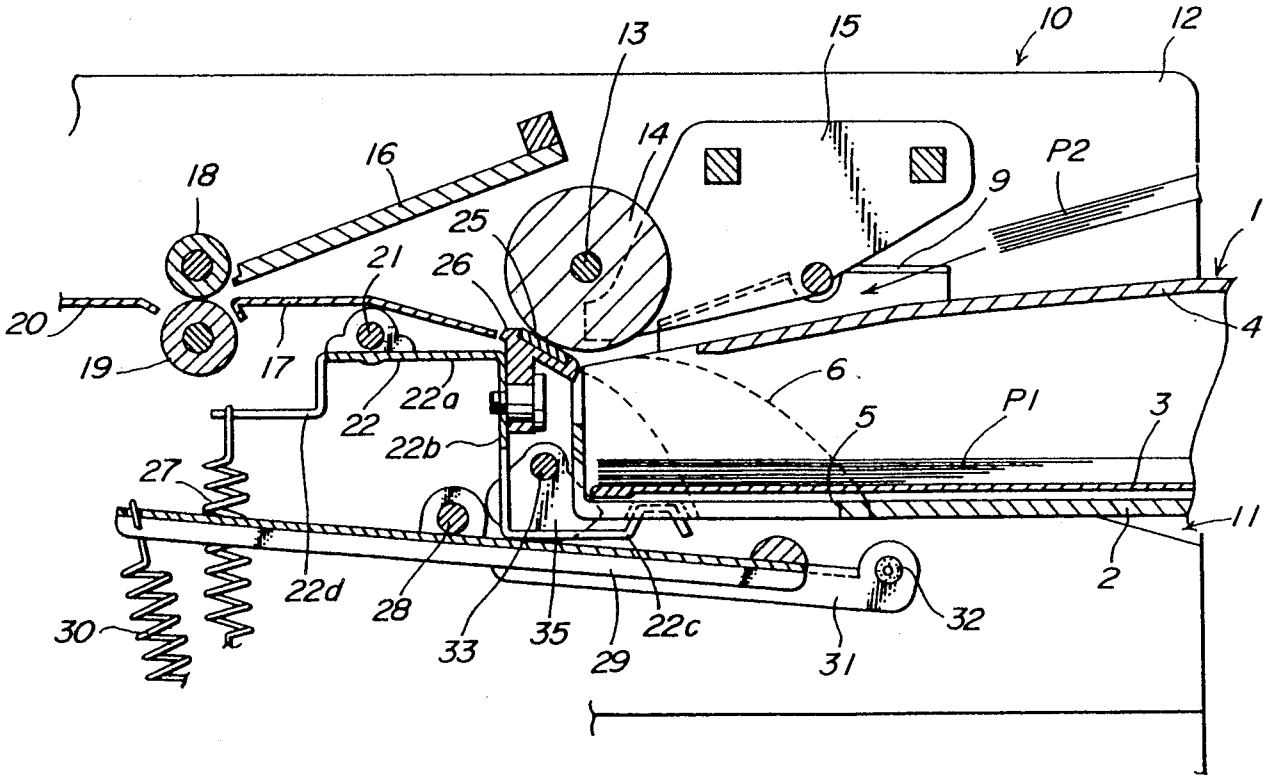

When one wishes to use recording paper other than that P1 on the main recording paper stacking table 3, one needs to operate the operation lever 34 to rotate the sector plate cams 35 clockwise through nearly 180 degrees, as shown in FIG. 4. As a result, the sector cams 35 push the levers 31 downwardly, rotating the levers 31 and the oscillating plate 29 clockwise. The rear end of the oscillating plate 29 moves through the window 5 to a position below the paper cassette 1. Thus, the main recording paper stacking table 3 rotates counterclockwise by its own weight until its front end is received by the bottom of the cassette case 2.

Next, one or several sheets of recording paper P2 are placed on the auxiliary recording paper stacking table 4 and inserted between the pair of width adjust guides 9 and between the bypass guide plate 15 and the auxiliary recording paper stacking table 4 until the front end of the paper comes below the paper pressing portion S of the paper supply roller 14.

Figure 5:
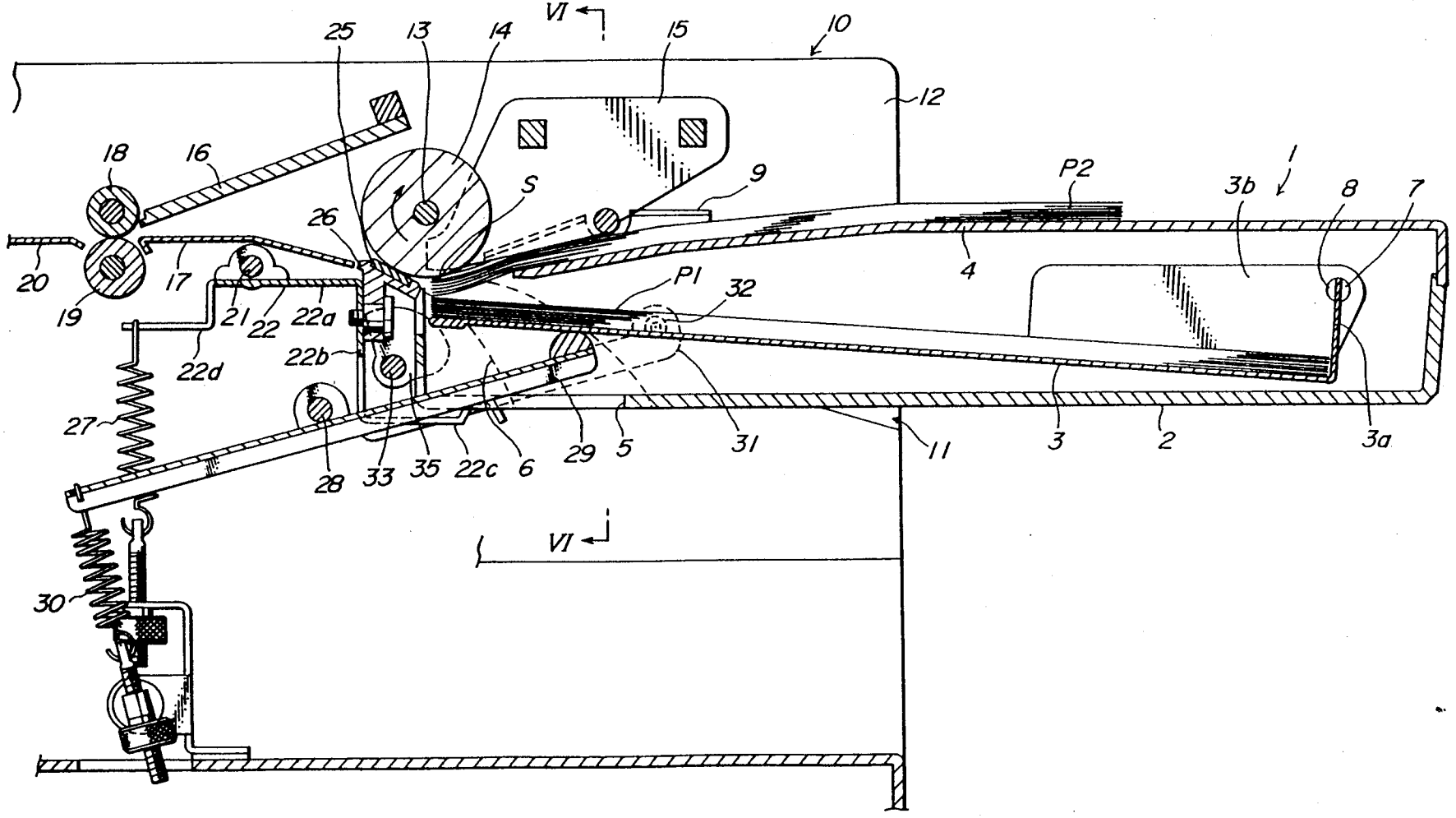
Figure 6:
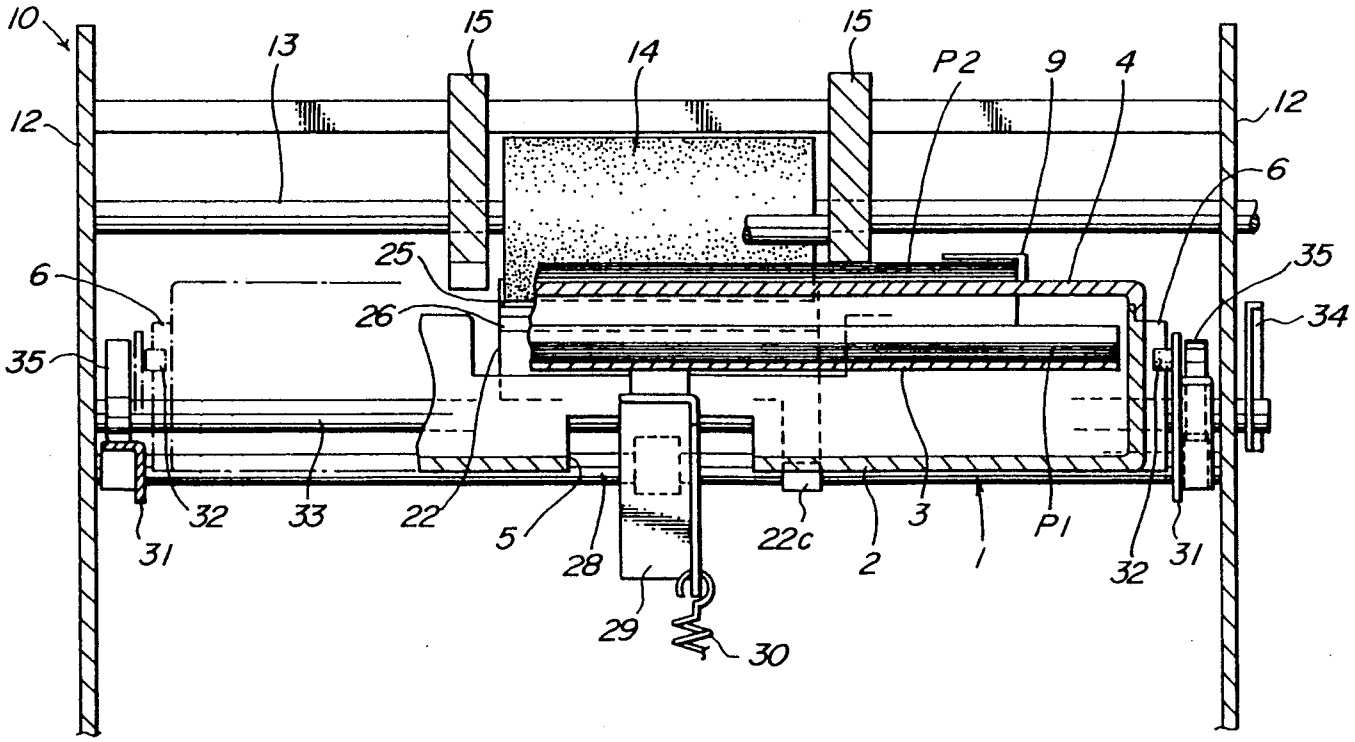

After this, the operation lever 34 is rotated counterclockwise to return the sector plate cam 35 to its original position. Then, the oscillating plate 29 and the levers 31 are rotated counterclockwise by the spring 30, pushing up the front part of the main recording paper stacking table 3 by the oscillating plate 29, as shown in FIGS. 5 and 6. Then, the front part of the recording paper P2 stacked on the auxiliary recording paper stacking table 4 is pushed up through the recording paper Pl on the main recording paper stacking table 3 so that the upper surface of the front part of the uppermost recording paper P2 on the auxiliary recording paper stacking table 4 is pressed against the paper pressing portion S of the paper supply roller 14. In this state, the paper supply roller 14 and the feed rollers 18, 19 are rotated to feed the recording paper P2 from the auxiliary recording paper stacking table 4 into the printer 10 one sheet at a time from the top of the stacked papers.

With the above paper supply apparatus, it is possible to supply recording paper P2 other than that P1 contained in the paper cassette 1 into the printer 10. The apparatus requires only one set of paper supply mechanism, such as the paper supply roller 14 and the feed rollers 18, 19. Furthermore, the paper supply mechanism need not be moved between the main and auxiliary recording paper stacking tables, making the construction very simple and compact.

While in the above embodiment, the main and auxiliary recording paper stacking tables 3, 4 are provided on paper cassette 1, these tables may be installed in the printer 10.

The features of the paper supply apparatus of this invention may be summarized as follows. The recording paper can be supplied either from the main recording paper stacking table or from the auxiliary recording paper stacking table. Because the apparatus requires only one set of paper supply mechanism such as the paper supply roller and because the paper supply mechanism need not be switched between the main and auxiliary recording paper stacking tables, the mechanism construction becomes simple, compact, and inexpensive.

What is claimed is:

1. A paper supply apparatus for supplying recording paper from either a main paper supply or an auxiliary paper supply comprising:

a paper supply roller including a paper pressing portion;

a main recording paper stacking table oscillatably supported in the apparatus and including a front end, the front end being disposed below the paper pressing portion of the paper supply roller and being capable of moving toward and away from the supply pressing portion;

an auxiliary recording paper stacking table including a front end, the auxiliary recording paper stacking table being disposed above the main recording paper stacking table, and the front end of the auxiliary recording paper stacking table extending close to the paper pressing portion of the paper supply roller;

main recording paper stacking table urging means for forcing the front end of the main recording paper stacking table towards the paper pressing portion of the paper supply roller; and oscillation means in communication with main recording paper stacking table urging means for oscillating the main recording paper stacking table against the force of the main recording paper stacking table urging means.

2. The paper supply apparatus according to claim 1, wherein said main recording paper stacking table urging means comprises an oscillating plate and a spring for urging said oscillating plate upwardly through the front end of the main recording paper stacking table, and said oscillating means comprises a lever and a cam rotated by said lever for oscillating said oscillating plate.

3. The paper supply apparatus according to claim 1, wherein the main recording paper stacking table is oscillatably supported in a paper cassette which is removably disposed in the apparatus and the auxiliary recording paper stacking table acts as a cover for the paper cassette, wherein when the front end of the main recording paper stacking table is displaced from the paper pressing portion of the paper supply roller, the auxiliary recording paper is stacked on top of the auxiliary recording paper stacking table, and when the front end of the main recording paper stacking table is moved toward the paper pressing portion of the paper supply roller, the auxiliary recording paper stacked on he auxiliary recording paper stacking table is brought into contact with the paper pressing portion of the paper supply roller.

4. The paper supply apparatus according to claim 2, wherein the main recording paper stacking table is oscillatably supported in a paper cassette which is removably disposed in the apparatus and the auxiliary recording paper stacking table acts as a cover for the paper cassette, wherein when the front end of the main recording paper stacking table is displaced from the paper pressing portion of the paper supply roller, the auxiliary recording paper is stacked on top of the auxiliary recording paper stacking table, and when the front end of the main recording paper stacking table is moved toward the paper pressing portion of the paper supply roller, the auxiliary recording paper stacked on the auxiliary recording paper stacking table is brought into contact with the paper pressing portion of the paper supply roller.

* * * * *

UNITED STATES PATENT AND TRADEMARK OFFICE

CERTIFICATE OF CORRECTION

PATENT NO. : 4,991,830

DATED : February 12, 1991

INVENTOR(S) : Toshio Yamanaka

It is certified that error appears in the above-identified patent and that said Letters Patent is hereby corrected as shown below:

Claim 1, column 6, line 27 change "supply" to --paper--.

Signed and Sealed this

Ninth Day of March, 1993

*Attest:*

*Attesting Officer*

STEPHEN G. KUNIN

*Acting Commissioner of Patents and Trademarks*